US007331294B2

(12) United States Patent
Mank

(10) Patent No.: US 7,331,294 B2
(45) Date of Patent: Feb. 19, 2008

(54) RIFLED SLUG

(75) Inventor: Peter Mank, Lengenhagen (DE)

(73) Assignee: Brenneke GmbH & Co. KG (DE)

( * ) Notice: Subject to any disclaimer, the term of this patent is extended or adjusted under 35 U.S.C. 154(b) by 36 days.

(21) Appl. No.: 10/528,088

(22) PCT Filed: Sep. 4, 2003

(86) PCT No.: PCT/DE03/02934

§ 371 (c)(1),
(2), (4) Date: Mar. 16, 2005

(87) PCT Pub. No.: WO2004/029539

PCT Pub. Date: Apr. 8, 2004

(65) Prior Publication Data

US 2006/0005730 A1 Jan. 12, 2006

(30) Foreign Application Priority Data

Sep. 25, 2002 (DE) ..... 102 44 571

(51) Int. Cl.
*F42B 10/22* (2006.01)
*F42B 10/24* (2006.01)
*F42B 7/10* (2006.01)

(52) U.S. Cl. ..... 102/524; 102/501

(58) Field of Classification Search ..... 102/501, 102/502, 503, 509, 510, 514, 515, 519, 524, 102/527

See application file for complete search history.

(56) References Cited

U.S. PATENT DOCUMENTS 3,256,816 A * 6/1966 Pilcher, II ..... 102/374
3,677,179 A * 7/1972 Potteiger et al. ..... 102/473
3,842,741 A * 10/1974 Brothers et al. ..... 102/490
4,233,902 A * 11/1980 Hartley et al. ..... 102/444
4,624,187 A * 11/1986 Bocker et al. ..... 102/520
4,964,341 A * 10/1990 Hebert ..... 102/501
4,977,834 A * 12/1990 Denis ..... 102/439
5,164,538 A * 11/1992 McClain, III ..... 102/517
5,677,505 A * 10/1997 Dittrich ..... 89/14.5
6,415,718 B1 * 7/2002 Saxby ..... 102/446
6,422,149 B1 * 7/2002 Saxby ..... 102/446

(Continued)

FOREIGN PATENT DOCUMENTS

EP 0341543 B1 10/1990

*Primary Examiner*—David Parsley
(74) *Attorney, Agent, or Firm*—Synnestvedt & Lechner LLP

(57) ABSTRACT

A rifled slug is provided with a metal head (1) and a plastic rear part (2), which is made as a single piece from a pin-shaped front part (5), with a rod-shaped middle part (6) joined to the rear of the front part, and with a plunger-shaped rear part (7). The front part (5) is inserted from the rear into a pocket hole of the metal head (1) and is joined thereto in a captive manner. This improves a rifled slug of the aforementioned type by increasing the precision, i.e. reducing the dispersion in the target. To this end, the front part (5) is provided in the form of a hollow body and is joined to the middle part (6) via a predetermined breaking point (14), whereby when shooting, the middle part (6) slides into the cavity of the front part (5) until the upper surface (19) of the rear part (7) strikes the lower surface (20) of the front part (5).

4 Claims, 1 Drawing Sheet

U.S. PATENT DOCUMENTS 6,492,632 B1 * 12/2002 Pollin ..... 244/3.3
6,502,516 B1 * 1/2003 Kinchin ..... 102/517
6,679,178 B2 * 1/2004 Mihaylov et al. ..... 102/439

* cited by examiner

RIFLED SLUG

CROSS REFERENCE TO RELATED APPLICATIONS

This application claims the priority of PCT Application PCT/DE2003/002934 filed Sep. 4, 2003 and German Patent Application 10 244 571.0 filed Sep. 25, 2002, the entire contents of which are hereby incorporated in total by reference.

BACKGROUND OF THE INVENTION

1. Field of the Invention.

The invention relates to a rifled slug type of gun-barrel projectile.

2. Description of Related Art.

This type of gun-barrel projectile is described in EP 0 341 543 B1. The upper part of the end part of this projectile is formed as a solid body. It has a slight radial expansion vis-à-vis the blind hole of in the lead head, so that it has to be inserted into it using a force. Then, at a plurality of locations on the periphery of the lead head, preferably at three places distributed uniformly on the periphery of the lead head, lead is driven pointwise radially inwardly, where the displaced lead flows into a peripheral groove of the upper part of the end part. This inward displacement of lead occurs using rod-shaped steel pins similar to a punched-in part. In virtue of the force fit of the upper part of the end part in the lead head and the pointwise incorporation of the lead in the upper part of the end part, the latter can be joined captively with the lead head.

In the case of this prior art gun-barrel projectile a predetermined breaking point is arranged between the rod-like central part and the piston-like bottom part of the end part, said breaking point being obtained at the time of manufacture in an injection molding process by insertion of a metal sleeve into the mold. This manufacturing process is relatively costly and prolongs the cycle time at the time of manufacture. A further drawback is the fact that the predetermined breaking point cannot be configured very uniformly. This has negative effects on the internal and external ballistics of the projectile.

In the evolution of firing the piston-like end part shifts upwards on the rod-like central part after detachment of the predetermined breaking point, until its upper side contacts the underside of the upper part. A barblike projection encircling the rod-like central part holds the end part on the central part thus preventing the central part from detaching itself rearwardly from the rod-like central during the flight phase of the projectile. During the flight phase the rear end of the rod-like central part projects rearwardly from the piston-like end part. This is a drawback for the external ballistics of the projectile, because of the flow conditions resulting therefrom in the posterior zone of the rear part. Also disadvantageous in this respect is the fact that the rearwardly projecting end of the rod-shaped central part is non-uniform in its external form because of the manufacturing process described.

In the hereinbefore described gun-barrel projectile a very good damping of the gas pressure increase is noted in the barrel. Nevertheless the predetermined breaking point rends after firing because of the relatively large tolerances from cartridge to cartridge caused by the manufacturing process at relatively widely differing gas pressures. This has effects on the further pressure development in the barrel and consequently on the exit velocity of the projectile. Accordingly, it leaves the barrel from firing to firing with relatively widely varying velocity, whereby target precision suffers.

SUMMARY OF THE INVENTION

The object of the present invention is to improve upon generic gun-barrel projectile, in that precision is increased; that is, the target spread is reduced.

In the rear part of the gun-barrel projectile according to the invention, therefore, there is the predetermined breaking point between the hollow upper part and the rod-shaped central part. It can be manufactured at this position substantially more precisely and more cost-effectively than at the position according to the prior art and discussed hereinbefore. A rending results upon lower gas pressure variations due to the lower tolerances of the predetermined breaking point; in other words, the gas pressure range in which the predetermined breaking point rends is smaller than in the prior art gun-barrel projectile. This has direct positive ramifications on the target accuracy.

A further advantage of the gun-barrel projectile according to the invention is in the fact that the posterior end of the rear part is formed in the flight phase by the formally precisely defined piston-shaped rear part. This results in defined flow relations, which positively influence the external ballistics of the projectile.

These and other features of the invention will be more fully understood by reference to the following drawings.

DETAILED DESCRIPTION OF THE INVENTION

During the course of this description, like numbers will be used to identify like elements according to the different views that illustrate the invention.

Figure 1:
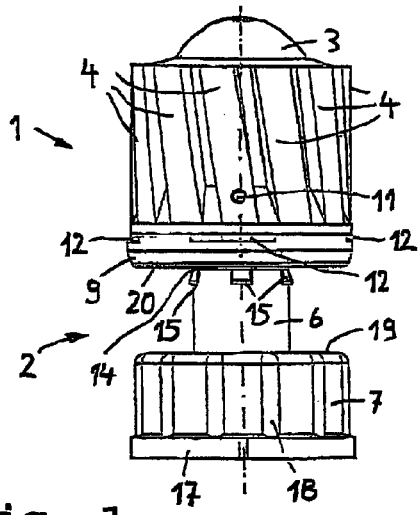
FIG. 1 represents a side view of a gun-barrel projectile before firing.

FIG. 1 represents a gun-barrel projectile, which is loaded in this form or in this condition by the manufacturer. It comprises a heavy lead head (1) and a lighter rear part (2) made out of lighter plastic. Because of the mass distribution, the gun-barrel projectile after leaving the gun barrel stabilizes in flight according to the arrow principle, because the center of gravity lies in front of the air attack point.

The lead head 1 has an essentially cylindrical shape and on its front surface it has a tip 3, which is intended for improving the air resistance. Slanted guide ribs 4 are distributed uniformly on the periphery. These guide ribs 4 enable passage through the choke of a gun, because they are urged away because of the ductility of the alloyed lead upon passing the choke. The load of the choke is, therefore, is no greater than in lead shot upon firing from the gun-barrel projectile.

Figure 3:
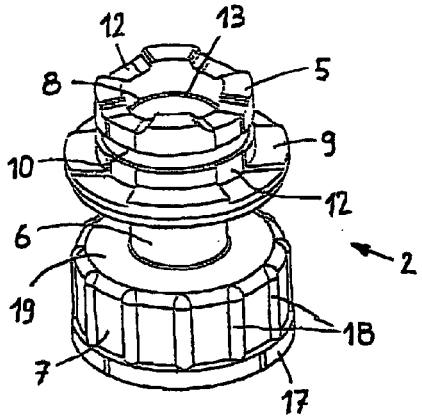
FIG. 3 represents a perspective representation of the rear part of the gun-barrel projectile before firing.
Figure 4:
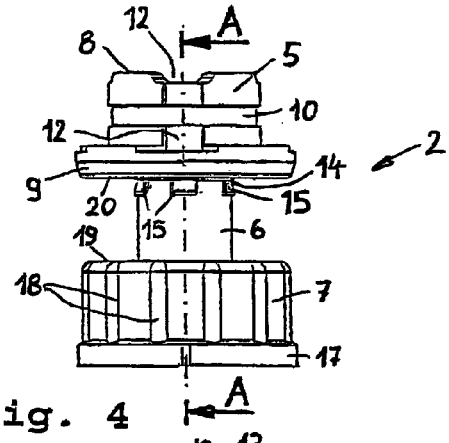
FIG. 4 represents a side view of the rear part corresponding to FIG. 3.
Figure 2:
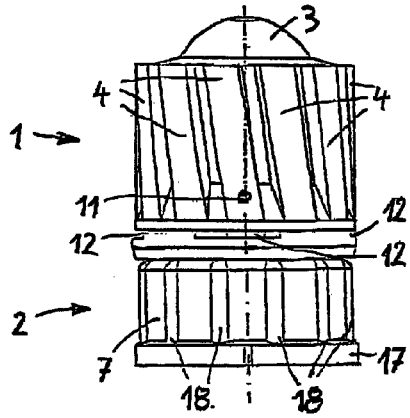
FIG. 2 represents an illustration of the gun-barrel projectile according to FIG. 1 after firing.
Figure 5:
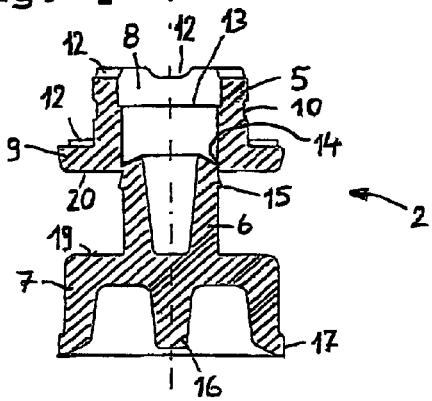
FIG. 5 represents a section A-A according to FIG. 4.

The rear part 2, whose embodiment is best seen in FIG. 3-5, is made of plastic in one piece using an injection molding technique. It consists of a anterior part 5, a central part 6 and a posterior part 7. The anterior part 5 has a hollow cylindrical body 8, which continues into a flange 9 of greater diameter towards the central part 6. In the assembled gun-barrel projectile (FIG. 1) the hollow cylindrical body 8 is seated with a slightly greater dimension in a corresponding cylindrical chamber in the lead head 1, which is not apparent from the diagrammatic representation. Along with the force fit between this chamber in the lead head 1 and the hollow cylindrical body 8 the captive connection of the lead head 1 and the rear part 2 is obtained, in that the lead is pressed by means of a needle-like stamp in the fashion of a punched-in part into a peripheral groove 10 of the hollow cylindrical body 8. This type of punched-in part 11 can be seen in the diagrammatic representation according to FIGS. 1 and 2. In general, the connection is made by means of two or three punched-in parts 11 evenly distributed on the periphery.

The flange 9 of the anterior part 5 serves as the support for the rear surface of the lead head 1. In this fashion, upon firing, in co-operation with the hollow cylindrical body 8 an even distribution of the gas pressure is produced on the lead head 1.

The anterior part 5 is provided with four air channels 12, which are arranged evenly on the periphery. When the lead head 1 is in place, these air channels 12 create a communication between the inside space of the hollow cylindrical body 8 and the atmosphere. They extend through the anterior face of the hollow cylindrical body 8, which abut in the assembled condition on the bottom of the chamber in the lead head 1, and then run one the outside of the hollow cylindrical body 8 over the flange 9 outwards. In addition, in the interior walls of the hollow cylindrical body 8 a flange 13 is provided by means of a increase in diameter. The function of the air channels 12 and of the flange 13 is explained in more detail in the following.

The central part 6 connects with the anterior part 5 via an annular predetermined breaking point 14. It is cylindrical and executed as a hollow body. The predetermined breaking point 14 can be produced at this point using an injection molding method relatively easily and with little variation in tolerance. On the outside surface, peripherally distributed barbed segments 15 are formed at the transition between the central part 6 and the anterior part 5, which—as will be explained in the following—co-operate with the flange 13 of the anterior part.

Figure 6:
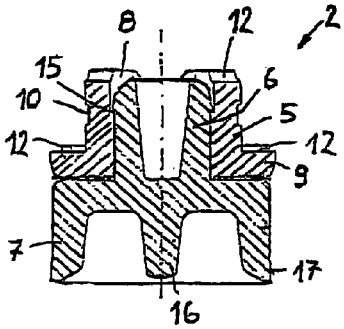
FIG. 6 represents an illustration of FIG. 5 after firing.

The central part 6 transitions—as can be seen particularly in FIGS. 5 and 6—relatively thickly walled into the posterior part 7, so that at this transition point no break or no deformation can from at the time of firing. The posterior part 7 is configured as an rearwardly open hollow cylinder, if a central plug 16 is eliminated. The posterior part 7 has the approximate diameter of the flange 9 of the anterior part 5 and terminates at the posterior end with a peripheral seal lip 17, which serves at the time of firing to seal the gas pressure to the barrel. For stabilizing the walls of the posterior part 7, same is provided with reinforcing ribs 18 distributed over its periphery.

In the following, the co-operation of the lead head 1 and the rear part 2 at the time of firing is described.

As has already been explained hereinbefore, FIG. 1 represents the loaded condition of the gun-barrel projectile. After firing of the propellant charge, a gas pressure builds, which acts on the cross-sectional area of the posterior part 7. Due to this pressure build-up, the predetermined breaking point 14 rends and the central part 6 pushes—because of the inertia of the heavy lead head 1—into the interior of the hollow cylindrical body 8 of the anterior part 5. That happens abruptly. When this happens, the air forced out of the inside space of the hollow cylindrical body 8 can flow off easily via the air channels 12, so that the incursion of the central part 6 into the anterior part 5 does not encounter any resistance due to pressure accumulation. At the end of this movement of the now two-part rear part 2, the upper surface 19 of the posterior part 7 contacts the lower surface 20 of the anterior part 5. The gun-barrel projectile has thus assumed the form represented in FIG. 2, with which it leaves the barrel of the weapon. This form is maintained until striking the target, because the central part 6 and the posterior part 7 are captively connected to the anterior part 5. This connection is realized by the co-operation of the barbed sections 15 of the central part 6 and the flange 13 in the inside walls of the hollow cylindrical body 8. After maximum depth penetration of the central part 6 into the anterior part 5, the barb-shaped sections 15 lock behind the flange 13, so that the central part 6 can not separate, at least not by the forces acting on the rear part 2 during the flight of the gun-barrel projectile. The engagement between the anterior part and the central part 6 and posterior part 7 is sown in FIG. 6.

While the invention has been described with reference to the preferred embodiment thereof, it will be appreciated by those of ordinary skill in the art that modifications can be made to the parts that comprise the invention without departing from the spirit and scope thereof.

The invention claimed is:

1. A gun-barrel projectile comprising:

a metal head having a blind hole; and a one piece, plastic rear part comprising a pin-shaped anterior part, a rod-shaped central part and a piston-like posterior part, and wherein the anterior part has a cylindrical body with a hollow space and inserts rearwardly into the blind hole of the metal head and is captively connected therewith, and is rigidly connected to the central part via a predetermined breaking point such that the lower surface of the anterior part is separated from the upper surface of the posterier part by substantially the length of the central part, whereby after firing the predetermined breaking point rends allowing the central part to then be pushed into the hollow space of the anterior part until the upper surface of the posterior part contacts the lower surface of the anterior part.

2. The gun-barrel projectile according to claim 1, wherein the anterior part is provided with air channels, which make possible a flow of air forced into the hollow space of the anterior part upon penetration of the central part.

3. The gun-barrel projectile according to claim 1, wherein barb-shaped sections are provided on the central part, which upon penetration of the central part into the hollow space of the anterior part grab behind a flange in the walls of the hollow space of the anterior part.

4. The gun-barrel projectile according to claim 2, wherein barb-shaped sections are provided on the central part, which upon penetration of the central part into the hollow space of the anterior part grab behind a flange in the walls of the hollow space of the anterior part.

* * * * *